United States Patent [19]

Brattan et al.

[11] Patent Number: 4,963,235

[45] Date of Patent: Oct. 16, 1990

[54] PROCESS FOR TREATING ELECTROLYTIC CELL PRODUCTS

[75] Inventors: Keith Brattan, Chester; Morris N. Nevin, Frodsham; Stephen F. Kelham, Northwich, all of England

[73] Assignee: Imperial Chemical Industries plc, London, England

[21] Appl. No.: 178,254

[22] Filed: Apr. 6, 1988

Related U.S. Application Data

[63] Continuation of Ser. No. 640,089, Aug. 13, 1984, abandoned.

[30] Foreign Application Priority Data

Aug. 15, 1983 [GB] United Kingdom ..... 8321934

[51] Int. Cl.[5] ..... C25B 1/16; C25B 1/26; C25B 15/08

[52] U.S. Cl. ..... 204/98; 204/128; 204/240; 204/241; 204/256; 204/258; 204/264; 204/266; 204/270

[58] Field of Search ..... 204/232, 240, 241, 255, 204/257, 258, 262, 264, 266, 270, DIG. 13, 98, 128

[56] References Cited

U.S. PATENT DOCUMENTS

| | | | |
|---|---|---|---|
| 1,632,285 | 6/1927 | Georgi | 204/278 X |
| 2,816,067 | 12/1957 | Keidel | 204/129 X |
| 3,062,732 | 11/1962 | Keidel | 204/278 X |
| 3,188,283 | 6/1965 | Cole | 204/278 X |
| 3,640,804 | 2/1972 | Westerlund | 204/95 |
| 3,793,163 | 2/1974 | Dotson | 204/98 |
| 3,855,091 | 12/1974 | Piester | 204/128 |
| 4,370,208 | 1/1983 | Iijima et al. | 204/128 X |
| 4,470,891 | 9/1984 | Moore et al. | 204/128 X |
| 4,481,088 | 11/1984 | Moore et al. | 204/128 X |
| 4,505,789 | 3/1985 | Ford | 204/258 |
| 4,515,665 | 5/1985 | Fair et al. | 204/128 X |
| 4,683,040 | 7/1987 | Seko | 204/128 X |
| 4,773,979 | 9/1988 | Wahl | 204/240 |

FOREIGN PATENT DOCUMENTS

| | | |
|---|---|---|
| EP-A10043945 | 1/1982 | European Pat. Off. . |
| 96214 | 3/1973 | German Democratic Rep. . |
| 1045102 | 10/1966 | United Kingdom . |
| 2005645 | 10/1977 | United Kingdom . |
| 1586952 | 3/1982 | United Kingdom . |

*Primary Examiner*—Donald R. Valentine

*Attorney, Agent, or Firm*—Cushman, Darby & Cushman

[57] ABSTRACT

An electrolytic cell of the type to which electrolyte is continuously charged and from which a product or products of electrolysis is or are continuously removed, the electrolytic cell being associated in close proximity with an item or items of apparatus in which electrolyte may be treated prior to charging to the electrolytic cell and/or in which a product or products of electrolysis may be treated after removal from the electrolytic cell. Also, a plurality of such electrolytic cells and items of apparatus. Electrolyte may be purified in the items of apparatus associated in close proximity with the electrolytic cells prior to charging to the cells, and the product streams from the cells may be treated in the items of apparatus prior to combining the product streams.

7 Claims, 1 Drawing Sheet

PROCESS FOR TREATING ELECTROLYTIC CELL PRODUCTS

Figure 1:
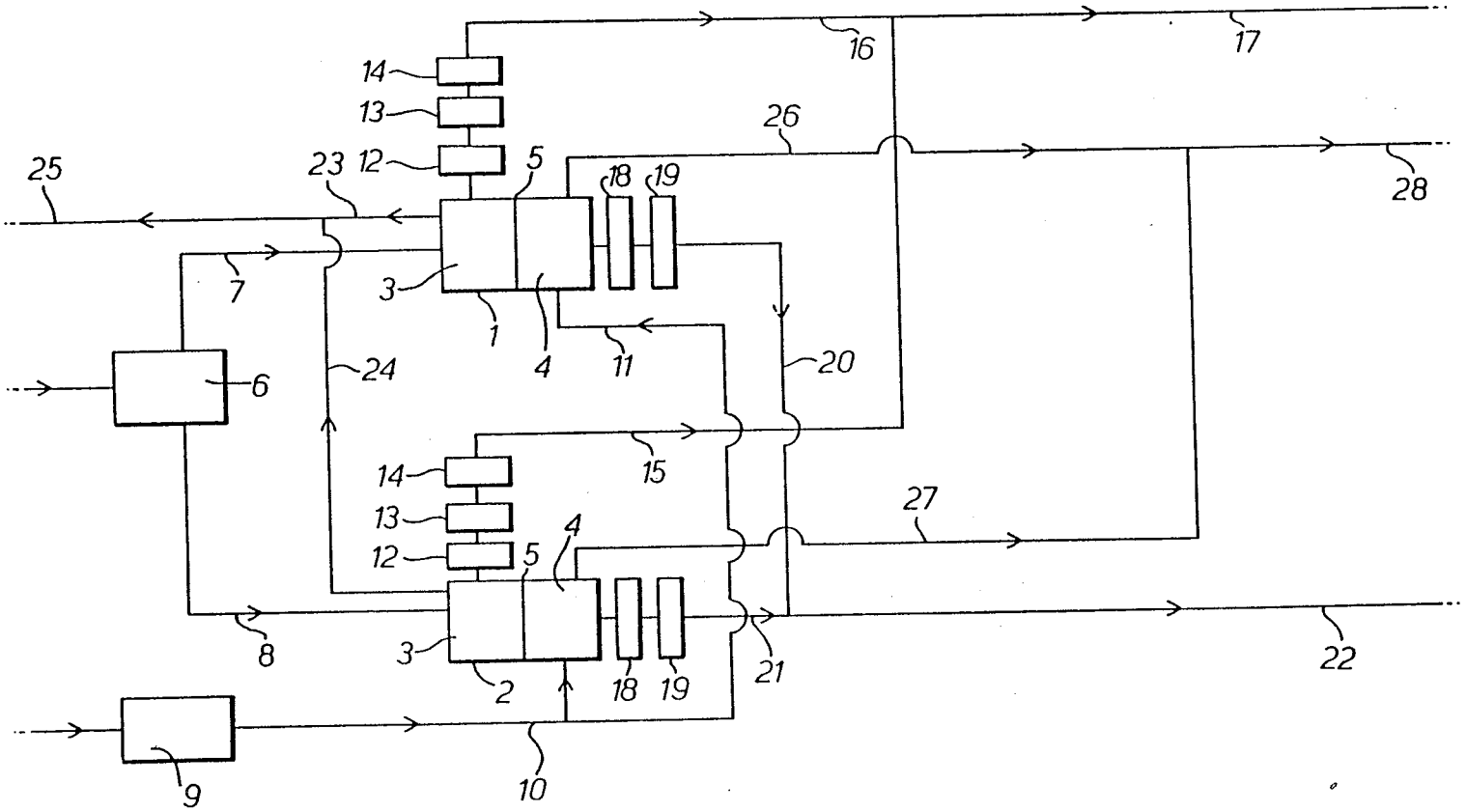

This is a continuation of application Ser. No. 640,089, filed Aug. 13, 1984 now abandoned.

This invention relates to an electrolytic cell, and in particular to a combination of an electrolytic cell and an apparatus, associated with the electrolytic cell, for treating the electrolyte and/or the products of electrolysis.

Electrolytic cells are used on a vast scale throughout the world for the production of a wide variety of materials by electrolysis. For example, aqueous solutions of alkali metal halides, particularly aqueous sodium chloride solutions, are electrolysed on a very large scale in plants throughout the world. Thus, sodium chloride may be electrolysed to produce gaseous chlorine, gaseous hydrogen, and an aqueous sodium hydroxide solution. Such an electrolysis may be carried out in electrolytic cells of the mercury type, of the porous diaphragm type, or of the ionically permselective membrane type. Alternatively, aqueous sodium chloride solution may be electrolysed to produce an aqueous solution of sodium chlorate and gaseous hydrogen, the electrolytic cell in this case not being equipped with a diaphragm or a membrane.

Such electrolytic cells, and particularly electrolytic cells of the types described in which aqueous solutions of alkali metal halides are electrolysed, have hitherto been operated in a socalled cell room comprising a large number of such cells. It has also been the practice hitherto in such a cell room to charge the electrolyte continuously to the cells from a common source of purified electrolyte, and to feed the products of electrolysis continuously from all the electrolytic cells to a common purification plant.

For example, in the electrolysis of aqueous sodium chloride solution the solution is first purified, e.g. by removal of divalent metals ions from the solution, e.g. calcium and magnesium ions, and the purified solution is then fed from the purification plant to each of the electrolytic cells. Also, in the electrolysis of aqueous sodium chloride solution one of the gaseous products of electrolysis is chlorine, which is produced at a relatively low pressure and in a form which contains water vapour and in which droplets of aqueous electrolyte are entrained. Hitherto, it has been the practice to combine the streams of gaseous chlorine from all of the electrolytic cells into a single stream and to purify this single stream of gaseous chlorine, for example by cooling, demisting, and drying the stream to remove electrolyte and water vapour therefrom.

Operating a cell room comprising a large number of electrolytic cells by charging electrolyte from a common source to each of the electrolytic cells, and operating a cell room by combining the products of electrolysis from the individual cells into a common stream prior to treatment of the products, particularly combining the gaseous products of electrolysis into a common stream prior to treatment thereof, may lead to substantial disadvantages.

For example, where a product of electrolysis is gaseous chlorine containing water vapour and having droplets of aqueous sodium chloride solution entrained therein, the chlorine is very corrosive. The corrosive nature of the chlorine necessitates the use of relatively expensive materials which are corrosion resistant, for example glass-reinforced plastics pipework, and equipment which is made of a corrosion resistant material, e.g. titanium, or which is at least lined with a corrosion resistant material. Furthermore the chlorine is at a relatively low pressure and a relatively high temperature of about 90° C. and it cannot readily be compressed until after it has been dried. As a consequence of this relatively low pressure and high temperature the pipework is necessarily of relatively large dimensions.

The present invention relates to an electrolytic cell and associated apparatus which assists in overcoming the afore-mentioned disadvantages.

According to the present invention there is provided an electrolytic cell of the type to which electrolyte is continuously charged and from which a product or products of electrolysis is or are continuously removed, characterised in that the electrolytic cell is associated in close proximity with an item or items of apparatus in which electrolyte may be treated prior to charging to the electrolytic cell and/or in which a product or products of electrolysis may be treated after removal from the electrolytic cell.

The electrolytic cell and the item or items of apparatus will hereinafter be referred to as a module.

By "associated in close proximity with" we mean that the electrolytic cell and the item or items of apparatus are at least adjacent to each other, or may abut against each other.

Thus, when the module of the present invention is used in electrolysis the electrolyte may be treated, e.g. in order to purify the electrolyte, in a module comprising an apparatus associated in close proximity with the electrolytic cell, and alternatively, or in addition, the product or products of electrolysis may be treated, e.g. in order to purify the product or products, in a module comprising an apparatus associated in close proximity with the electrolytic cell, prior to combining the product streams from a plurality of electrolytic cells. This is in contrast to the practice hitherto in which electrolyte is charged to a plurality of electrolytic cells from a common treatment, e.g. purification, apparatus, and in which the product or products of electrolysis from a plurality of electrolytic cells are combined prior to feeding to a treatment, e.g. purification, apparatus.

The invention also provides a plurality of electrolytic cells of the type described which are associated in close proximity with an item or items of apparatus in which electrolyte may be treated prior to charging to the electrolytic cell and/or in which a product or products of electrolysis may be treated after removal from the electrolytic cell. Thus, the invention also provides a plurality of modules as described.

Where the invention comprises a plurality of modules as described electrolyte may be charged from a source thereof to each module and it may be treated in the apparatus of each module and/or a product or products of electrolysis may be treated in apparatus associated with each module and thereafter the product of products from each module may be combined.

Where the invention comprises a plurality of electrolytic cells of the type described each of the electrolytic cells may be associated in close proximity with an item or items of apparatus in which electrolyte may be treated prior to charging to the electrolytic cell and/or in which a product or products of electrolysis may be treated after removal from the electrolytic cell. However, the invention may comprise a plurality of electrolytic cells and a plurality of items of such apparatus in which said item or items of apparatus are each associated in close proximity with a plurality of electrolytic cells, particularly with a small number of such electrolytic cells. For example, such an item or items of apparatus may be associated with two or three electrolytic cells. In this case electrolyte may be charged from a source thereof and be treated in an apparatus, the electrolyte then being distributed to the small number of electrolytic cells associated in close proximity with the apparatus, and/or the streams of a product or products of electrolysis from the small number of electrolytic cells may be combined and passed to the item of apparatus associated in close proximity therewith and treated therein. Thereafter the product streams from each such apparatus may be combined into a single stream.

Where an electrolyte is treated in order to purify the electrolyte prior to charging to the electrolytic cell all of the required treatment, or some only, may be effected in the item or items of apparatus associated in close proximity with the electrolytic cell. Similarly, where a product or products of electrolysis is or are treated after removal from the electrolytic cell all of the required treatment, or some only, may be effected in the item or items of apparatus associated in close proximity with the electrolytic cell.

The invention is not limited to use in the electrolysis of any particular electrolyte. However, it is particularly suitable for use in the electrolysis of aqueous alkali metal chloride solution.

Examples of treatments which may be effected in the apparatus associated with an electrolytic cell in the module where aqueous alkali metal chloride is to be electrolysed include the following. The invention is not limited to the treatments hereinafter described.

Purification of the aqueous alkali metal chloride electrolyte, for example to remove therefrom divalent metal ions, e.g. calcium and magnesium ions. The purification may be effected by passing the electolyte through an ion-exchange resin contained in the apparatus.

Purification of gaseous products of electrolysis. For example, liquid entrained in the gaseous hydrogen and chlorine may be removed, e.g. by filtration, for example, in an apparatus comprising a fibrous filter.

Drying of gaseous products of electrolysis. For example, gaseous hydrogen and chlorine may be dried, e.g. by passing the gaseous products through a liquid drying medium, e.g. sulphuric acid, contained in the apparatus.

Entrained liquid drying medium may be removed from the gaseous products of electrolysis, for example, by filtration in an apparatus comprising a fibrous filter.

The gaseous products of electrolysis may be cooled in an apparatus which forms part of the module. For example, cooling may be effected in an apparatus which is in the form of a heat-exchanger, particularly in an apparatus which is in the form of a plate heat exchanger.

Chlorine may be liquefied in an apparatus which forms a part of the module, for example, by application of elevated pressure to cooled gaseous chlorine. The electrolytic cell may be operated under elevated pressure.

It will be appreciated that one or more of the aforementioned treatment steps may be effected in apparatus associated with the electrolytic cell in the module of the invention, and that the module may comprise more than one such apparatus associated with each electrolytic cell each apparatus being designed to fulfill a particular function.

An example of an advantage which results from use of the module of the present invention will now be described.

As has been explained hereinbefore, chlorine is produced in an electrolytic cell in a form which is very corrosive, and collection of the chlorine streams from a plurality of electrolytic cells into a common stream prior to purification e.g. drying and removal of entrained electrolyte, necessitates use of expensive corrosion resistant pipework. If chlorine produced in an electrolytic cell is purified, e.g. dried, demisted, and possibly cooled in a unit of apparatus associated in close proximity with the electrolytic cell, that is in a module of the present invention, the chlorine which emerges from the module is much less corrosive than is chlorine containing water vapour and having droplets of electrolyte entrained therein, and in consequence the pipework and associated equipment through which the chlorine is subsequently passed need be much less corrosion resistant than the pipework and associated equipment which has necessarily been used hitherto, with consequent economic advantages. Furthermore, if the chlorine is cooled in a module of the present invention, and particularly where it is compressed, the pipework which is required is of much smaller dimensions than has been required hitherto.

Other advantages of the use of a module of the present invention will be associated with the electrolysis of electrolytes other than aqueous alkali metal halide solutions, and it is to be understood that the module of the present invention is suitable for use in the electrolysis of electrolytes other than aqueous alkali metal halide solutions.

The electrolytic cell in the module of the present invention may comprise an anode, or a plurality of anodes, and a cathode, or a plurality of cathodes, and optionally the anodes(s) and adjacent cathode(s) may be separated by a separator, which may be a hydraulically permeable porous diaphragm or a substantially hydraulically impermeable ion permselective membrane. The nature of the anode, and the cathode, and of the separator where present, will depend on the nature of the electrolyte to be electrolysed in the electrolytic cell. By way of example, suitable anodes, cathodes, and separators, for use in an electrolytic cell for the electrolysis of aqueous alkali metal chloride solution will now be described.

The anodes in the electrolytic cell may be metallic, and a preferred metal is a film-forming metal.

The film-forming metal may be one of the metals titanium, zirconium, niobium, tantalum or tungsten or an alloy consisting principally of one or more of these metals and having anodic polarisation properties which are comparable with those of the pure metal. It is preferred to use titanium alone, or an alloy based on titanium and having polarisation properties comparable with those of titanium.

The anode may carry a coating of an electroconducting electrocatalytically active material. This coating may for example consist of one or more platinum group metals, that is platinum, rhodium, iridium, ruthenium osmium and palladium, or alloys of the said metals, and/or an oxide or oxides thereof. The coating may consist of one or more of the platinum group metals and/or oxides thereof in admixture with one or more non-noble metal oxides, particularly a film-forming metal oxide. Especially suitable electrocatalytically active coatings include those based on ruthenium dioxide/titanium dioxide.

The cathode in the electrolytic cell may be metallic, and the metal may be for example steel, copper, nickel or copper or nickel-coated steel.

The cathode may carry a coating of a material which reduces the hydrogen overvoltage at the cathode when the electrolytic cell is used in the electrolysis of water of aqueous solutions, e.g. aqueous alkali metal chloride solution. Such coatings are known in the art.

The anodes and cathodes may be provided with means for attachment to a power source. For example, they may be provided with copper members which are suitable for attachment to appropriate bus-bars.

Where the separator to be used in electrolytic cell is a hydraulically permeable porous diaphragm the diaphragm should be resistant to degradation by the electrolyte and by the products of electrolysis and, where an aqueous solution of alkali metal chloride is to be electrolysed, the diaphragm is suitably made of a fluorine-containing polymeric material as such materials are generally resistant to degradation by the chlorine and alkali metal hydroxide produced in the electrolysis. Preferably, the porous diaphragm is made of polytetrafluoroethylene, although other materials which may be used include, for example, tetrafluoroethylene-hexafluoropropylene copolymers, vinylidene fluoride polymers and copolymers, and fluorinated ethylene-propylene copolymers.

Suitable porous diaphragms are those described, for example, in UK Patent No. 1503915 in which there is described a porous diaphragm of polytetrafluoroethylene having a microstructure of nodes interconnected by fibrils, and in UK Patent No. 1081046 in which there is described a porous diaphragm produced by extracting a particulate filler from a sheet of polytetrafluoroethylene. Other suitable porous diaphragms are described in the art.

Where the separator to be used in the electrolytic cell is a hydraulically impermeable ionpermselective membrane the membrane should be resistant to degradation by the electrolyte and by the products of electrolysis and, where an aqueous solution of alkali metal chloride is to be electrolysed, the membrane is suitably made of a fluorine-containing polymeric material containing cation-exchange groups, for example, sulphonic acid, carboxylic acid or phosphonic acid groups, or derivatives thereof, or a mixture of two or more such groups.

Suitable cation-exchange membranes are those described, for example, in UK Patents Nos. 1184321, 1402920, 14066673, 1455070, 1497748, 1487749, 1518387, and 1531068.

The electrolytic cell in the module of the present invention suitably is of the filter press type comprising a plurality of anodes and cathodes of the plate type. The apparatus associated with the electrolytic cell in the module may also suitably comprise a plurality of plates and frames which form a compartment or a plurality of compartments. For example, where gaseous products of electrolysis are to be cooled in the apparatus the apparatus may comprise a plate-type heat exchanger. Where gaseous products of electrolysis are to be dried the apparatus may comprise a plurality of plates and frames defining a compartment or a plurality of compartments in the apparatus which may contain a drying medium and through which the gaseous products of electrolysis may be passed. Where liquid, for example liquid droplets of electrolyte are to be removed from the gaseous products of electrolysis, the apparatus may comprise a plurality of plates and frames defining a compartment or a plurality of compartments which may contain a filtration medium, e.g. a fibrous filter.

Apparatus of the aforementioned type may readily be associated with or affixed to an electrolytic cell of the filter press type, for example by bolting thereto.

The module of the present invention offers the advantage that where an apparatus in the module no longer functions satisfactorily for its intended purpose, it may readily be replaced by another apparatus which has been pre-assembled.

The invention is illustrated in FIG. 1 which is a diagrammatic representation of a plant for the production of aqueous sodium hydroxide solution, hydrogen and chlorine by the electrolysis of aqueous sodium chloride solution.

For the sake of simplicity the plant is shown as comprising two electrolytic cells (1, 2) although it is to be understood that the plant may comprise many more electrolytic cells, for example 50 cells or even up to 100 cells or more. Each electrolytic cell comprises an anode compartment (3) and a cathode compartment (4) separated by a cation-permselective membrane (5).

The plant comprises a stock tank (6) of purified aqueous sodium chloride solution and lines (7, 8) leading from the stock tank (6) to the anode compartments (3) of the electrolytic cells (1, 2). The plant also comprises a tank of water or of dilute aqueous alkali metal hydroxide solution (9) and lines (10, 11) leading from the tank (9) to the cathode compartments (4) of the electrolytic cells (1, 2).

Associated with and in close proximity with each of the anode compartments (3) of the electrolytic cells (1, 2) are three units of apparatus (12, 13, 14) which in use serve, respectively, to remove entrained liquid droplets from the gaseous chlorine produced in the anode compartments (3), to dry the chlorine, and to cool the chlorine. Lines (15, 16) lead from the units of apparatus (12, 13, 14) to a single line (17) which in turn leads to a chlorine storage tank (not shown).

Associated with and in close proximity with each of the cathode compartments (4) of the electrolytic cells (1, 2) are two units of apparatus (18, 19) which in use serve, respectively, to dry hydrogen produced in the cathode compartments (4) and to cool the hydrogen. Lines (20, 21) lead from the units of apparatus (18, 19) to a single line (22).

Lines (23, 24) for depleted aqueous sodium chloride solution lead from the anode compartments (3) of the electrolytic cells (1, 2) to a single line (25), and lines (26, 27) for aqueous sodium hydroxide solution lead from the cathode compartments (4) of the electrolytic cells (1, 2) to a single line (28).

In operation aqueous sodium chloride solution from the stock tank (6) is supplied continuously via lines (7, 8) to the anode compartments (3) of the electrolytic cells (1, 2), and water or dilute aqueous sodium hydroxide solution is supplied continuously from tank (9) via lines (10, 11) to the cathode compartments (4) of the electrolytic cells (1, 2).

The aqueous sodium chloride solution is electrolysed in the electrolytic cells (1, 2) and depeleted solution is removed continuously from the anode compartments (3) via lines (23, 24, 25). This solution may be dechlorinated, resaturated, purified and returned to the stock tank (6) for re-use.

Aqueous sodium hydroxide solution produced in the cathode compartments (4) of the electrolytic cells (1, 2) is removed therefrom via lines (26, 27, 28) and passed to a storage tank (not shown).

Chlorine produced in the anode compartments (3) of the electrolytic cells (1, 2) is passed successively through the units of apparatus (12, 13, 14) in which it is, respectively, freed of liquid droplets, dried, and cooled, and the thus dry, cool chlorine is passed via lines (15, 16) to a common line (17) and thence to a chlorine storage tank (not shown).

Hydrogen produced in the cathode compartments (4) of the electrolytic cells (1, 2) is passed successively through the units of apparatus (18, 19) in which it is, respectively, dried and cooled and the thus dry, cool hydrogen is passed via lines (20, 21) to a common line (22) and thence to a hydrogen storage tank (not shown).

We claim:

1. In a process in which electrolyte is continuously charged from a source thereof to a plurality of electrolytic cells and is electrolysed therein and from which a gaseous product or products of electrolysis is or are continuously removed therefrom and combined into a common stream, the improvement which comprises associating each electrolytic cell in close proximity with an item or items of apparatus in which a gaseous product or products of electrolysis may be treated after removal from the electrolytic cell and prior to being combined into a single stream, said item or items of the apparatus comprising a compartment or plurality of compartments formed from a plurality of plates and frames, and the process comprising filtering and/or drying a gaseous product or products of electrolysis in the item or items of apparatus prior to combining the gaseous product or products into a single stream.

2. A process as claimed in claim 1 in which the item or items of apparatus additionally function as a heat exchanger.

3. A process as claimed in claim 1 in which the compartment or plurality of compartments contain a drying medium.

4. A process as claimed in claim 1 in which the compartment or plurality of compartments contain a filtration medium.

5. A process as claimed in claim 4 in which the electrolytic cells are of the filter press type.

6. A process as claimed in claim 1 in which gaseous chlorine produced by electrolysis of aqueous alkali metal chloride solution is filtered and/or dried.

7. A process as claimed in claim 1 in which gaseous hydrogen produced by electrolysis of aqueous alkali metal chloride solution is filtered and/or dried.

* * * * *